US009114415B2

(12) United States Patent
Williams et al.

(10) Patent No.: US 9,114,415 B2
(45) Date of Patent: Aug. 25, 2015

(54) SYSTEM AND METHOD FOR DISPENSING SPRAYABLE MATERIAL

(71) Applicant: Aervoe Industries Inc., Gardnerville, NV (US)

(72) Inventors: Mark Williams, Genoa, NV (US); Michael Joseph Bennett, Zephyr Cove, NV (US)

(73) Assignee: Aervoe Industries, Inc., Gardnerville, NV (US)

( * ) Notice: Subject to any disclaimer, the term of this patent is extended or adjusted under 35 U.S.C. 154(b) by 0 days.

(21) Appl. No.: 14/492,461

(22) Filed: Oct. 7, 2014

(65) Prior Publication Data

US 2015/0053717 A1 Feb. 26, 2015

Related U.S. Application Data

(63) Continuation-in-part of application No. 14/011,096, filed on Aug. 27, 2013, now Pat. No. 8,910,831, which is a continuation-in-part of application No.

(Continued)

(51) Int. Cl.

| | |
|---|---|
| ***B65D 35/56*** | (2006.01) |
| ***B05B 11/04*** | (2006.01) |
| ***B05C 17/005*** | (2006.01) |

(Continued)

(52) U.S. Cl.

CPC ..... *B05B 11/048* (2013.01); *B05B 11/02* (2013.01); *B05C 17/00583* (2013.01); *B05C 17/015* (2013.01); *B05C 17/0136* (2013.01); *B05C 17/0146* (2013.01); *B65D 75/5883* (2013.01); *B05C 17/0123* (2013.01);

(Continued)

(58) Field of Classification Search

CPC .. B05B 11/02; B05B 11/048; B05B 11/3011; B05B 11/3015; B05C 17/00583; B05C 17/0136; B05C 17/0146; B05C 17/015; B05C 17/0123; B65D 75/5883; B65D 83/201; B65D 83/203; B67D 1/108; B67D 1/0004

USPC ..... 222/1, 95, 105, 174, 214, 325–326, 222/333, 386, 391, 402.1, 402.15, 504

See application file for complete search history.

(56) References Cited

U.S. PATENT DOCUMENTS

| | | | | |
|---|---|---|---|---|
| 3,443,725 | A * | 5/1969 | Lawhorn | 222/79 |
| 7,056,307 | B2 * | 6/2006 | Smith et al. | 604/207 |

(Continued)

*Primary Examiner* — Frederick C Nicolas

(74) *Attorney, Agent, or Firm* — Watson Rounds; Marc D. Foodman

(57) ABSTRACT

A system and method for dispensing sprayable material such as paint and other liquefied products. The system includes a dispenser such as a marking stick or other commercially available dispenser. The dispenser is configured to accept a container housed inside a cartridge and filled with sprayable material. The sprayable material is sprayed through a valve and spray tip at one end of the cartridge. An electrically powered motor assembly is removably coupled to the cartridge. The motor is used to power a pump that is incorporated in the cartridge to draw the sprayable material from the container. The material is pumped from the container and delivered through a tube to a spray head. The pressure generated by the pump inside the container and the tube are sufficient to spray the product through the valve and spray tip when valve is opened.

28 Claims, 19 Drawing Sheets

Related U.S. Application Data

12/831,263, filed on Jul. 7, 2010, now Pat. No. 8,544,686.

(60) Provisional application No. 61/270,568, filed on Jul. 10, 2009.

(51) Int. Cl.

| | |
|---|---|
| ***B05B 11/02*** | (2006.01) |
| ***B05C 17/015*** | (2006.01) |
| ***B65D 75/58*** | (2006.01) |
| *B67D 1/00* | (2006.01) |
| *B65D 83/20* | (2006.01) |
| *B67D 1/10* | (2006.01) |
| *B05C 17/01* | (2006.01) |

(52) U.S. Cl.

CPC ..... *B65D 83/201* (2013.01); *B65D 83/203* (2013.01); *B67D 1/0004* (2013.01); *B67D 1/108* (2013.01)

(56) References Cited

U.S. PATENT DOCUMENTS 8,544,686 B2 * 10/2013 Williams ..... 222/95
8,910,831 B2 * 12/2014 Williams ..... 222/95

* cited by examiner

SYSTEM AND METHOD FOR DISPENSING SPRAYABLE MATERIAL

RELATED U.S. APPLICATION DATA

This is a continuation in part of application Ser. No. 14/011,096 filed Aug. 27, 2013 entitled "System for Dispensing Sprayable Material," which is a continuation-in-part of U.S. application Ser. No. 12/831,263 filed Jul. 7, 2010 entitled "System for Dispensing Sprayable Material," which claims priority benefit from provisional application No. 61/270,568 filed on Jul. 10, 2009 entitled "System for Dispensing Sprayable Material."

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

Aerosol cans for depositing paint and other sprayable materials have been in use for some time. The term "aerosol" as used herein refers to a suspension of liquid or solid particles in a gas. Most aerosol cans are made of tin-plated steel or aluminum. Once an aerosol can has been used and emptied in any of its many possible applications such as for food, beverage, paint and aerosol products, it is in demand for recycling. There are over three billion aerosol cans manufactured in the U.S. annually. Many of the products contained in these cans, such as paint products, light lubricants, starting fluids, polishes and waxes, and cleaners, contain substantial amounts of volatile organic compounds (VOCs) as solvents and include flammable propellants. As a result, partially empty aerosol cans are treated as a hazardous waste at collection centers, military bases, industries utilizing large quantities of aerosols, and treatment, storage, and disposal facilities. Typically, an aerosol package consists of a pressurized liquid product packaged inside a hermetically sealed can that is dispensed through a push button spray tip/valve combination. The pressure is created in the aerosol can via a propellant that atomizes the chemical contents and creates the force to easily dispense the product through the valve/tip in a cost effective manner. The spray delivery which is efficient and effective is commonly used across a wide array of products. The hermetic seal saves the product from contamination during storage.

Some specialized products use a bag or container inside a pressurized can. The liquid product is stored inside the bag and the propellant is inside the space in the can surrounding the bag. The propellant creates pressure on the bag to force the product through the spray tip/valve system for use. This type of aerosol packaging can be expensive and redundant and is typically used in creams and lotions. Given the public's concern about solid waste disposal, the aerosol industry teamed with the steel industry to promote the collection of empty aerosol cans in recycling programs nationwide. Thousands of communities now include aerosol product recycling in both household residential and curbside buy-back and drop-off programs. However, solid waste management firms are questioning the potential safety hazards of processing even 'empty' aerosols. This safety question is primarily due to the highly flammable propellants still contained in many cans even when the liquid contents are discharged.

There have been extensive efforts to find alternative solutions to aerosol cans, many of which have proven unsatisfactory. The use of aerosol bags without the can is an option that has not been previously addressed in the prior art. The rigid exterior of a can has been considered essential because of safety concerns for a user in the event that an aerosol bag bursts, causing injury from the propellant materials contained inside the can, or the possibility of fire fueled by these materials. An enormous amount of resources are expended to manufacture cans, collect empty cans, and recycle the empty cans. As a result, it would be highly beneficial to find a solution for deploying aerosol bags but without the can and the propellant. Such a solution would eliminate flammability concerns during dispensing, while still providing the performance results of a spray can application.

In one embodiment of the present invention, a system utilizes a flexible, crushable container similar to the type of container used in some aerosol products, although without a surrounding can and propellant. A dispenser having an elongated housing is provided for receiving the bag. The dispenser is a gun type device that uses a plunger to apply force to the bottom of the bag while the top of the bag with the valve and spray tip is held securely in a slot or valve seat in the other end of the housing. The force exerted by the plunger within the housing creates the hydrostatic pressure inside the bag needed to spray the product through the valve and spray tip. A first trigger and handle on the device are squeezed together to exert force on the plunger. This, in turn, compresses a container spring creating the hydrostatic pressure inside the bag. The user then pulls a second trigger, which activates the valve and dispenses the product. As the product is dispensed, the bag collapses and the container spring extends to its free length. At this point there is little or no pressure on the bag. In a mechanical version of the system, the user renews the cycle by squeezing the first trigger and handle to move the plunger while compressing the container spring and re-creating the hydrostatic pressure needed to dispense remaining product from the bag. The user again pulls the second trigger to dispense the product. This cycle is repeated until the bag is emptied.

In an alternative embodiment of the present invention, a system utilizes a modified flexible, crushable container or bag similar to the type of the first embodiment, or alternatively a rigid or semi-rigid container. The container in this alternative embodiment is provided within a cartridge in the shape of a can and without a propellant. A dispenser for spraying the material may be a standard marking stick or other commercially available dispenser adapted to receive the cartridge with the crushable container. An electrically powered motor assembly is coupled to the cartridge. The motor is used to power a pump that is incorporated into the cartridge to draw the sprayable material from the container. The material is pumped from the container and delivered through a tube to a spray head. The pressure generated by the pump inside the bag and the tube are sufficient to spray the product through the valve and spray tip when valve is opened. A mechanical actuator or switch mounted on the motor assembly and accessible by the user, is activated to turn the pump on and off. When the pump is initially turned on, it creates pressure inside the container and through the tube. The user then pulls a manual trigger mounted on the marking stick or other dispenser, which opens the valve at the spray head dispensing the sprayable material. As the product is dispensed, pressure is maintained by the motor and the container is vacated of material until it is fully emptied.

BRIEF DESCRIPTION OF THE DRAWINGS

For a better understanding of the present invention, and to show more clearly how it functions, reference will now be made, by way of example, to the accompanying drawings. The drawings show preferred embodiments of the present invention in which.

DETAILED DESCRIPTION

Figure 1:
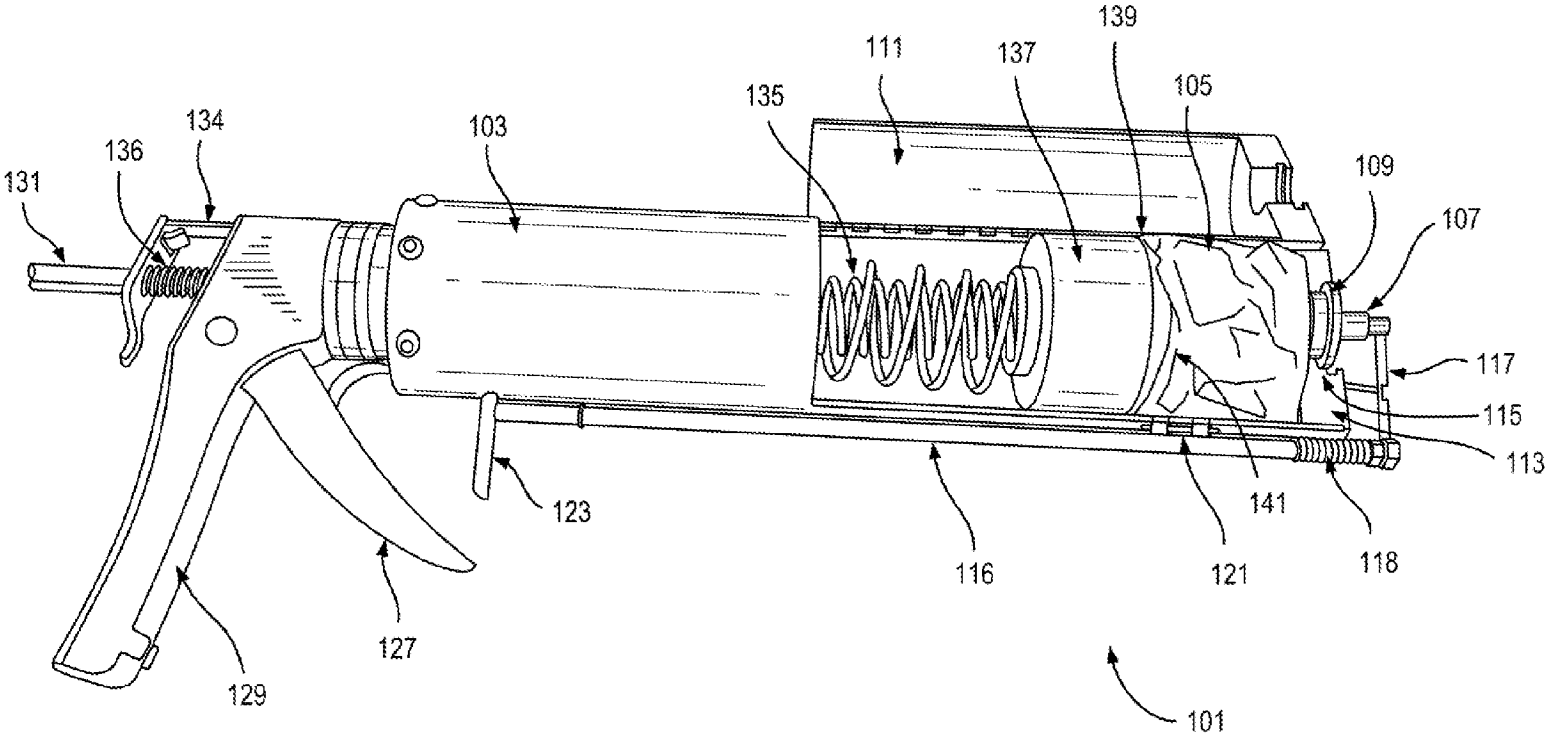
FIG. 1 is a side exterior view of a first embodiment of the dispenser of the system of the present invention.

The present invention will now be described more fully with reference to the accompanying drawings. It should be understood that the invention may be embodied in many different forms and should not be construed as limited to the embodiments set forth herein. Throughout FIGS. 1-26, like elements of the invention are referred to by the same reference numerals for consistency purposes.

Figure 2:
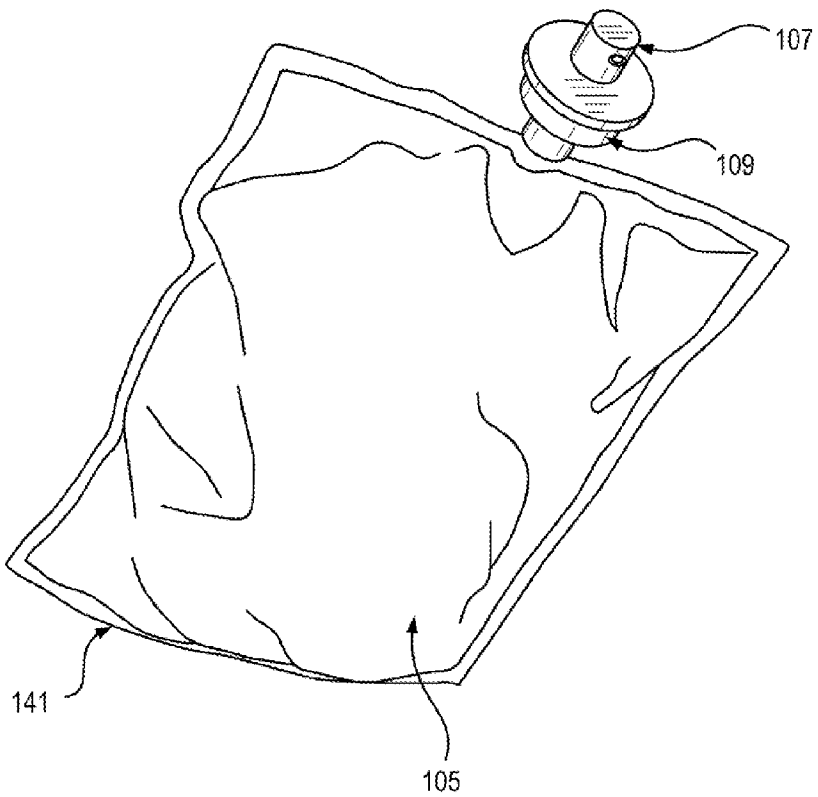
FIG. 2 is a side exterior view of a first embodiment of a crushable container with a valve and spray tip.
Figure 3:
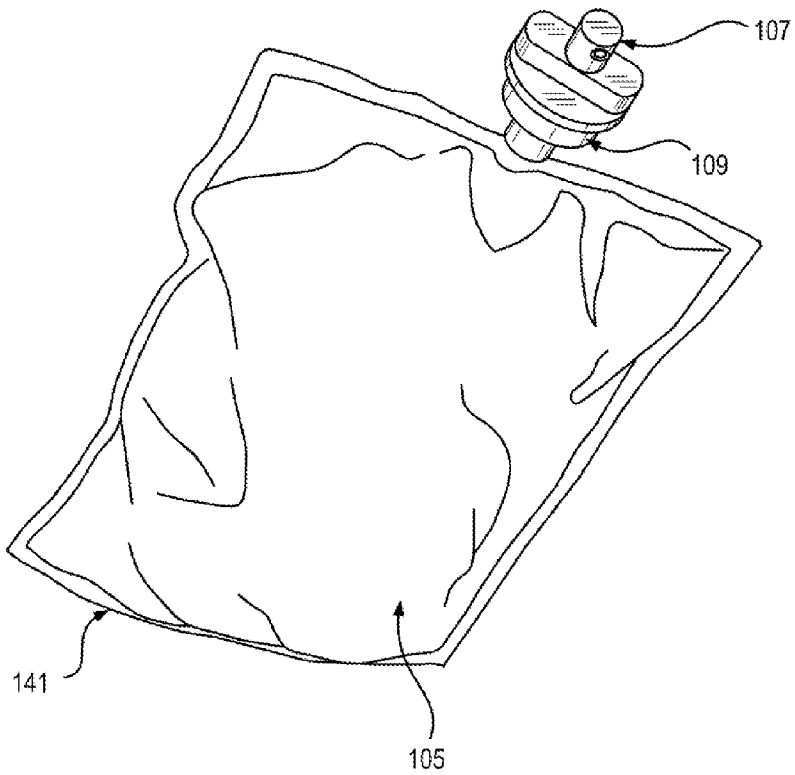
FIG. 3 is a side exterior view of a second embodiment of a crushable container with a valve and spray tip.
Figure 4:
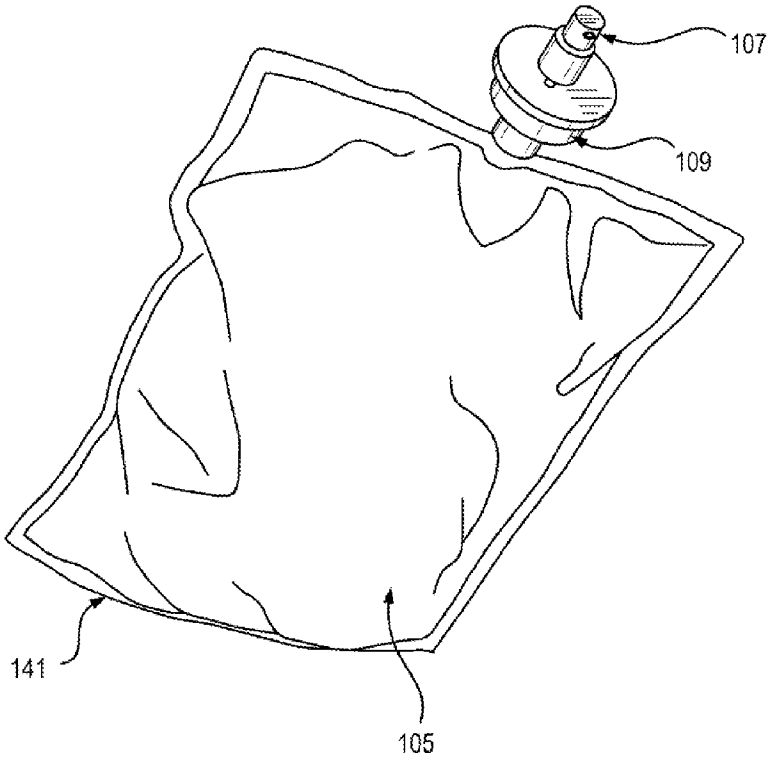
FIG. 4 is a side exterior view of a third embodiment of a crushable container with a valve and spray tip.

FIGS. 1-11 show various views of a dispenser system 101 with a dispenser in the general shape of a gun. Elongated cylinder shaped housing 103 is configured to receive a flexible bag or flexible container 105. Container 105 is shown in FIGS. 2-4 with three different valve and tip embodiments, although there are other embodiments that would work with dispenser system 101 as well.

Container 105 is sealed, and is filled with a sprayable liquid material such as paint. At one end of container 105 is a cap area that has a spray tip 107 situated at the end of a valve 109. Valve 109 is attached to container 105. Spray tip 107 can be of different types. FIG. 2 shows spray tip 107 with a side spray configuration. This type of spray tip is activated by pushing down and to the side and is also referred to as a triangle tilt configuration. FIGS. 3 and 4 show other spray tip types that are both activated by depressing the tip downward in a direction towards the body of bag 105.

Referring to FIGS. 1 and 5-11, container 105 is placed in housing 103 with valve 109 seated in valve seat 113 that is set in the forward end of housing 103. In FIG. 1, spray tip 107 is the depress-activated type like that shown in FIG. 4. A hinged panel 111 matching the shape of housing 103 opens to allow housing 103 to receive container 105 and closes once container 105 has been placed inside. Valve seat 113 is shaped to keep valve 109 in an immobilized state during operation of dispenser 101 with fingers 115 extending on either side of valve 109.

Alternative embodiments for activating spray tip 107 are contemplated and will be apparent to one skilled in the art. In the embodiments shown in FIGS. 5-11, trigger rod 117 makes contact with the forward surface of valve seat 113 and is attached to trigger plate 119. Trigger plate 119 is a substantially triangular flat component that provides a mounting point at each of its three corners. While trigger rod 117 is attached to one mounting point, the second mounting point is attached to trigger bracket 121. The third mounting point of trigger plate 119 is attached to spray trigger 123. Trigger pin 125 secures trigger rod 117 such that, when a user pulls spray trigger 123, trigger rod 117 pulls back spray tip 107 thereby allowing the pressurized contents of container 105 to spray through valve 109 and spray tip 107, and deliver the contents of container 105 as needed.

In an alternative embodiment for activating spray tip 107 shown in FIG. 1, spray trigger 123 can be mounted along the bottom of dispenser housing 103. Instead of using trigger plate 119 and trigger bracket 121, a design using a trigger extender 116, trigger rod 117 and trigger rod spring 118 could be used. Trigger rod 117 is mounted to the end of trigger extender 116. A trigger bracket 121 secures trigger extender 116 to housing 103. By pulling back on spray trigger 123, trigger extender 116 moves with trigger 123 to pull back on trigger rod 117. This action pushes down on spray tip 107 releasing the materials from container 105.

A combination of a plunger trigger 127 and a handle 129 is used to apply a load to the bottom of container 105. Plunger trigger 127 and handle are in a hinged configuration that is squeezed together to cause a pumping action that applies pressure to container 105. The pumping action drives a plunger 131 that has progressive ratchet notches 133 along its length. A plunger bracket 134 is affixed to the housing for keeping plunger 131 in place and a plunger spring biases the plunger in position relative to housing bracket 134. Pressure on container 105 can be re-applied as plunger 131 moves along its length and is re-engaged in the progressive notches as needed when pressure inside container 105 drops below an acceptable level. By repeatedly squeezing plunger trigger 127, a piston spring 135 that sits between housing 103 and plunger bracket 134 is compressed and pressed forward against a piston (or force platen) 137. Piston 137 is substantially flat on both sides and being of large enough width and mass to apply pressure on container 105 while maintaining its shape. The front surface 139 of piston 137 presses against a bottom surface 141 of container 105 with piston 137 being held in place by a surrounding interior surface 143 of housing 103. It is contemplated that during use of dispenser 101, a user alternates between pulling spray trigger 123 to dispense the contents of container 105 as needed, and pumping plunger trigger 127 to restore pressure to container 105.

Figure 6:
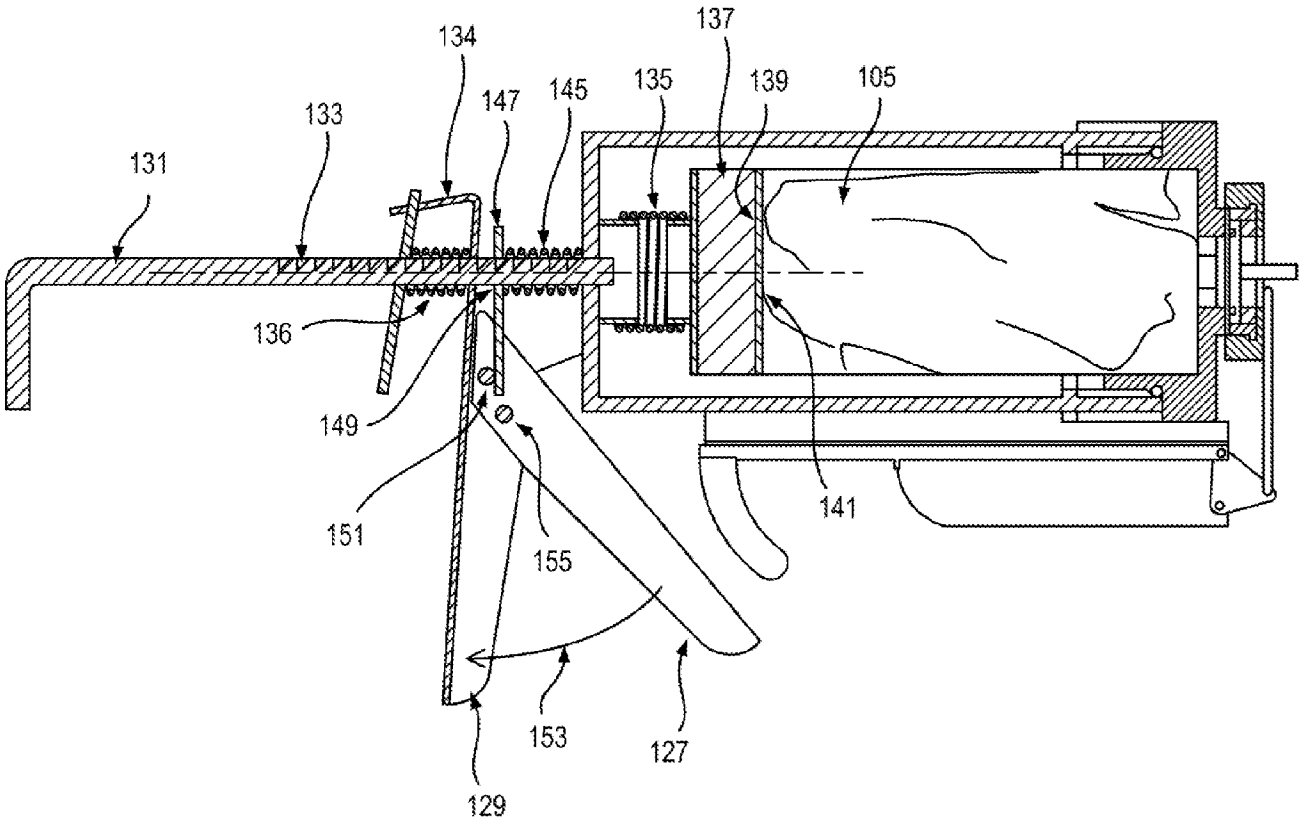
FIG. 6 is an exploded cross-sectional view of the plunger and associated components of the present invention wherein the plunger trigger is shown in an open position in the second embodiment.

A configuration for ratcheting plunger 131 is shown in FIG. 6. A biasing spring 145 and a jam plate 147 having a hole 149 for receiving the plunger 131 are shown. Jam plate 147 is disposed about plunger 131 and rests against an inside surface of handle 127 and a driving pin 151 attached to plunger trigger 127. Biasing spring 145 urges jam plate 47 away from housing 103 so that it is pressed against driving pin 151 and plunger trigger 127

Figure 7:
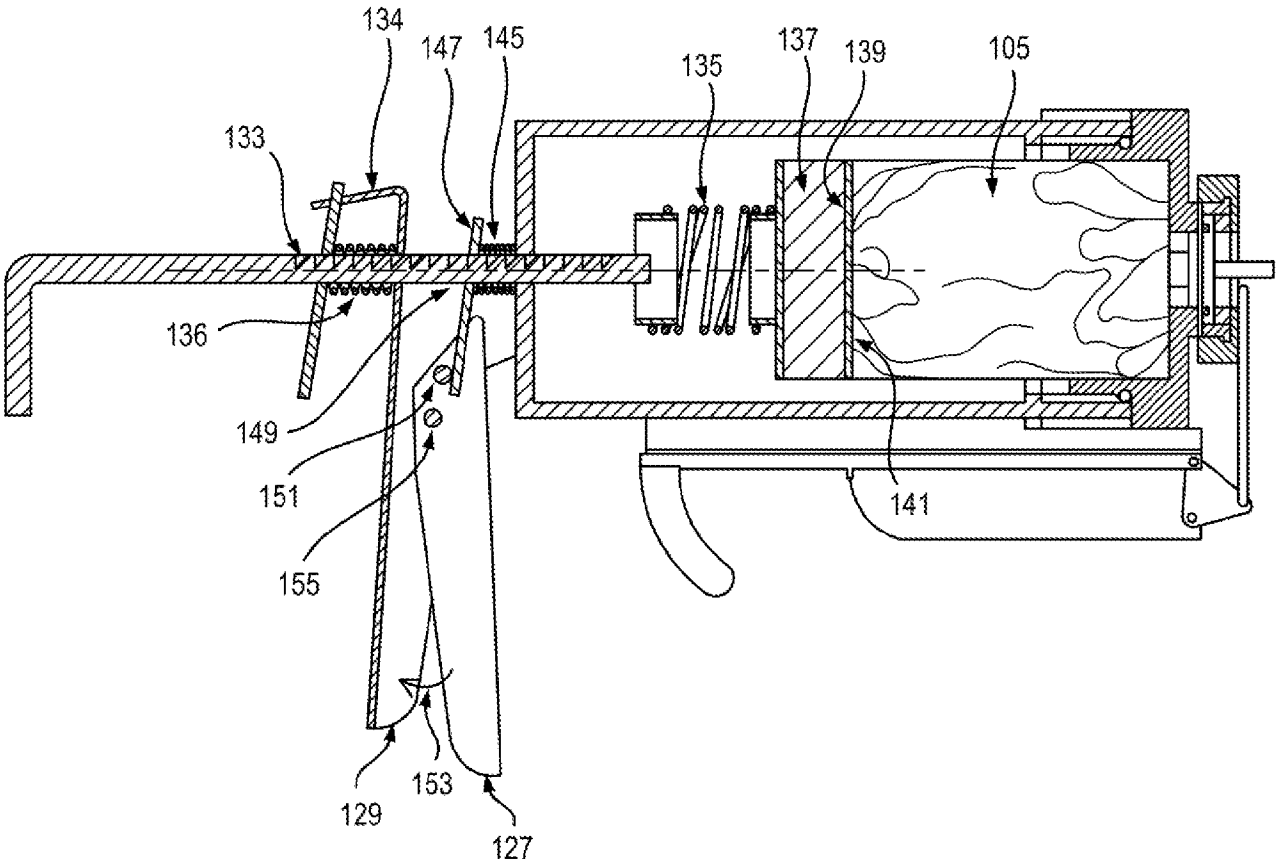
FIG. 7 is an exploded cross-sectional view of the plunger and associated components of the present invention wherein the plunger trigger is shown partially depressed in the second embodiment.

A description of the operation of the biased-spring 145 is as follows: handle 129 is depressed in the direction of arrow 153, pivoting about pivot pin 155 so that driving pin 151 moves the lower edge of jam plate 147 forward, toward housing 103. This causes the jam plate to cant so that it jams on one of the notches 133 along the length of plunger 131. Then, as plunger trigger 127 is moved further in the direction of arrow 153, jam plate 147 and plunger 131 move together towards housing 103. FIG. 7 shows plunger trigger 127 in the fully depressed state.

Figure 5:
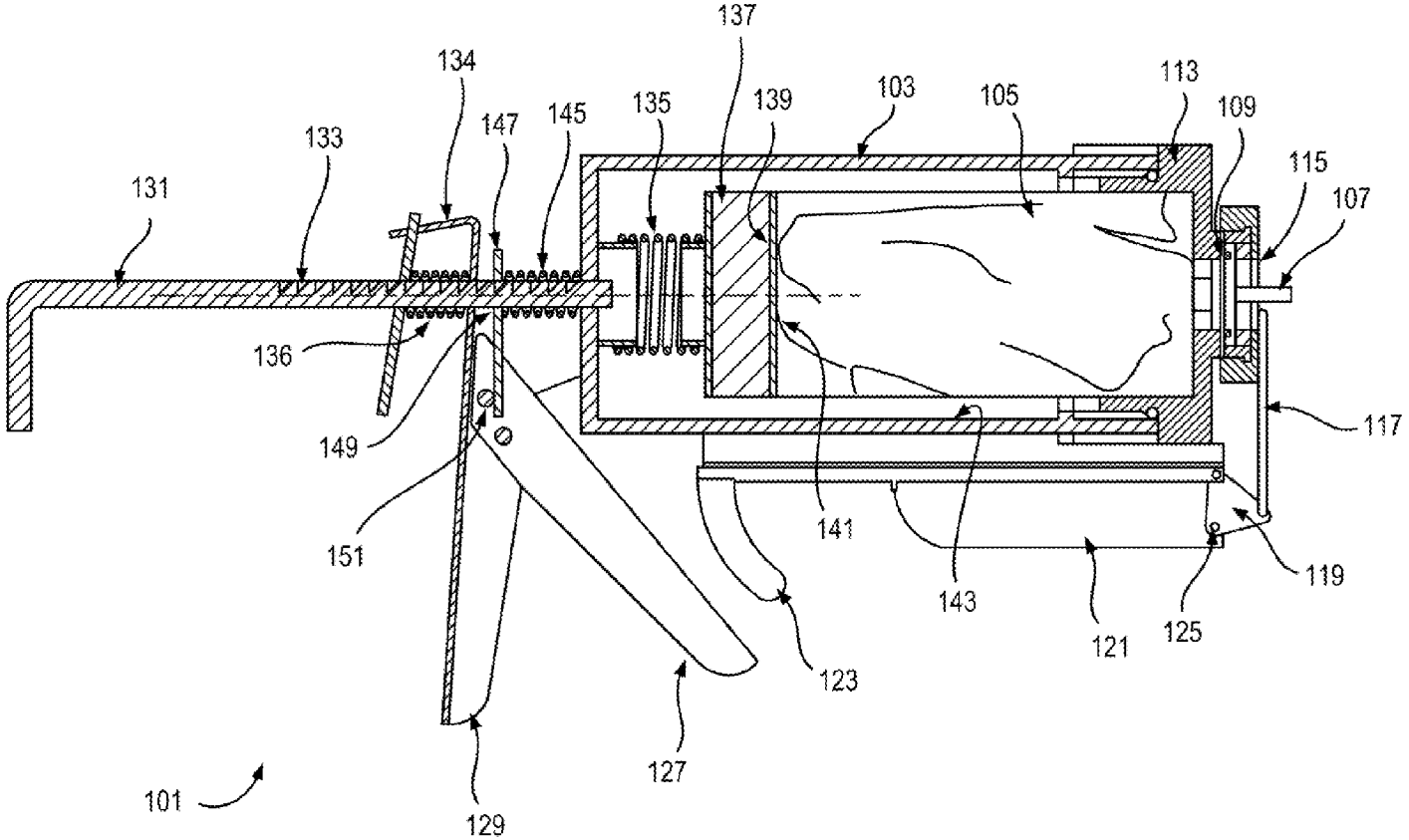
FIG. 5 is a cross-sectional view showing the internal components of the present invention in a second embodiment.
Figure 8:
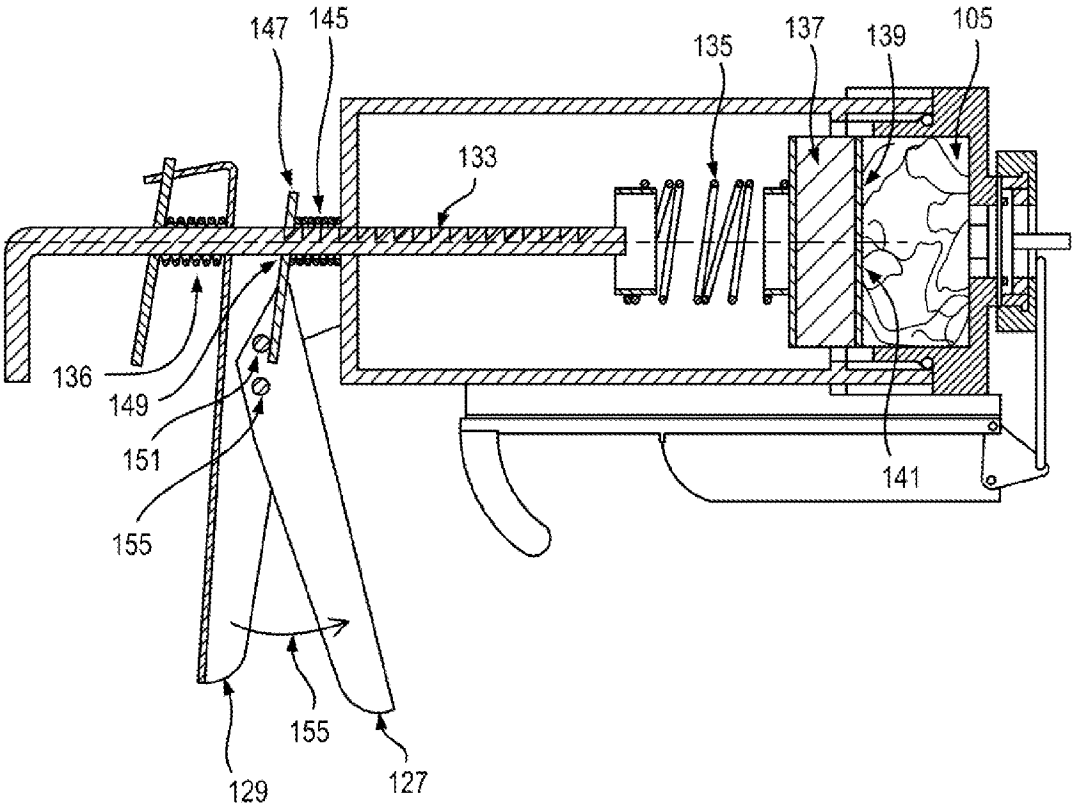
FIG. 8 is an exploded cross-sectional view of the plunger and associated components of the present invention wherein the plunger trigger has been released in the second embodiment.

When plunger trigger 127 is released it moves in the direction of arrow 155, as shown in FIG. 8. Jam plate 147 and plunger 131 move backward, together, away from housing 103. When plunger trigger 127 is fully released, jam plate 147 again rests against the inside surface of handle 129 and driving pin 151, having been moved back into position by biasing spring 145. With plunger trigger 127 fully released, as shown in FIG. 5 there is no resistance on plunger 131 and it slides freely through handle 129, jam plate 147, biasing spring 145, and housing 103.

The action of plunger 131 drives piston 137 against bottom surface 141 of container 105 crushing it from the bottom up as piston 137 moves along inside housing 103. As noted above, piston 137 is preferably a solid disk shape with a width large enough to prevent it from bending or otherwise causing it to become misshapen as it exerts force on container 105. Piston 137 may be made of metal, plastic or other materials that hold their shape. The operative features of piston 137 will now be described.

As described above, operation of plunger trigger 127 in the direction of arrow 153 moves plunger 131 while simultaneously allowing piston spring 135 to extend to push piston 137 against bottom surface 141 of container 105. As shown in FIG. 6 and FIG. 7, moving plunger 131 in the direction of container 105 causes piston 137 to contact and exert force on container 105 crushing it as piston 137 slides along the inside of housing 103. The crushing action on container 105 continues as piston spring 135 and piston 137 move in unison along the inside of housing 103. In addition to having a width permitting it to maintain its shape, piston 137 is also designed in a cylindrical shape to fit snugly within the cylindrical interior portion of housing 103. Interior surface 143 of housing 103 acts as a guide for piston 137 to keep it in place as it moves inside housing 103.

While forming housing 103 and piston 137 in a cylindrical shape has been proven to work, it is also possible that housing 103 and piston 137 could take on other shapes provided they are compatible. Interior surface 143 of housing 103 functions as a guide for piston 137 as the sidewalls of piston 137 contact interior surface 143 during operation of dispenser 101. It should also be noted that housing 103 works best when fully enclosed. One embodiment that is shown in the figures includes hinged panel 111 that is closed once container 105 is seated within housing 103. A hinge works well to ensure proper positioning of panel 111 and to prevent loss of panel 111 when it is open during loading of container 105. However, panel 111 could be removable without a hinge using tabs or other components to keep it in place. Or, slots could be cut in the side of housing 103 to allow the user to have a view of container 105 during operation so that a user can determine when container 105 is empty or nearly empty.

Figure 9:
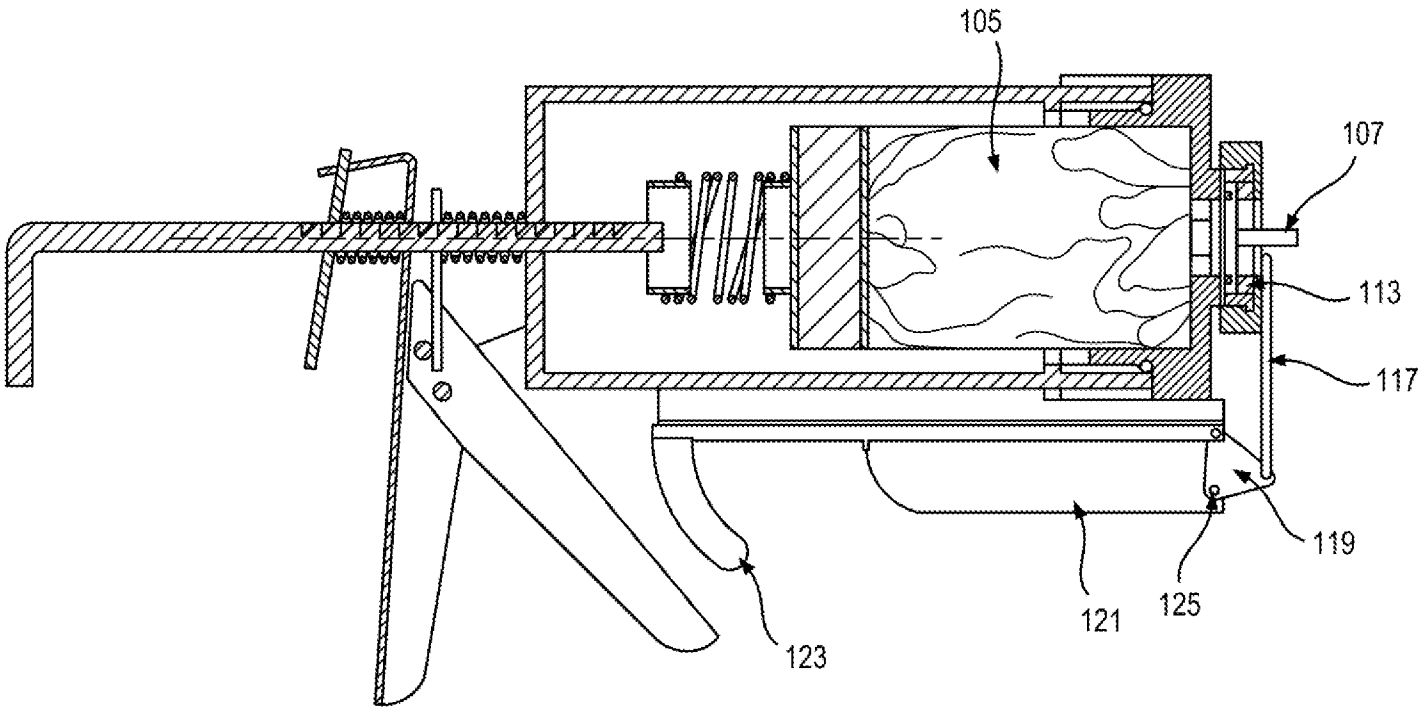
FIG. 9 is an exploded cross-sectional view of the spray trigger and associated components of the present invention where the spray trigger is in an initial state in the second embodiment.

Once plunger 131 is locked in place, jam plate 147 engages one of notches 133 along plunger 131 and container 105 is under pressure from piston 137 as it exerts force against bottom surface 141 of container 105. Container 105 is ready to release its contents through spray tip 107 as shown in FIG. 9.

Figure 10:
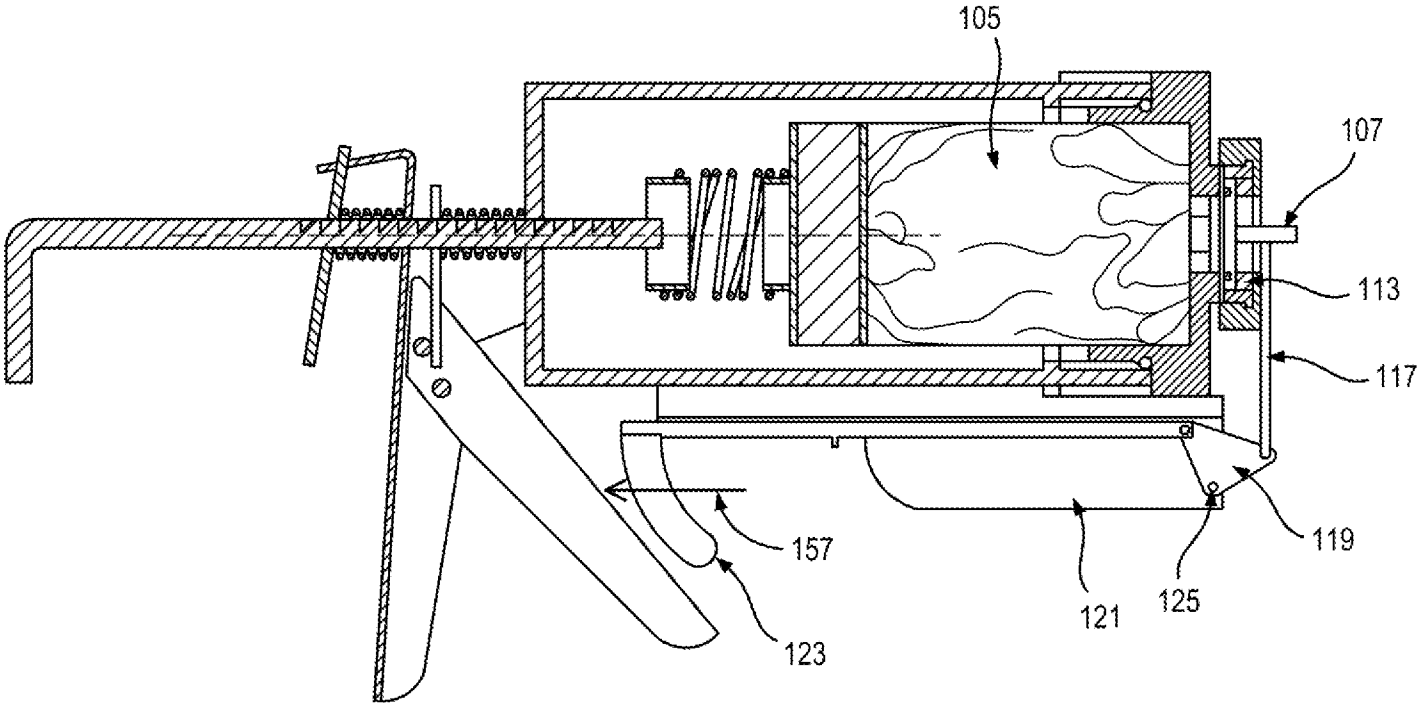
FIG. 10 is an exploded cross-sectional view of the spray trigger and associated components of the present invention where the spray trigger is has been released in the second embodiment.

To operate spray tip 107, a user pulls spray trigger 123 as shown in FIG. 10 in the direction of arrow 157. Trigger rod 117 contacts the forward surface of valve seat 113 and is attached to trigger plate 119. Trigger plate 119 is a substantially triangular flat component that provides a mounting point at each of its three corners. While trigger rod 117 is attached to one mounting point, the second mounting point is attached to trigger bracket 121. The third mounting point of trigger plate 119 is attached to spray trigger 123. Trigger pin 125 secures trigger rod 117 such that, when a user pulls spray trigger 123, trigger rod 117 pulls back spray tip 107, thereby allowing the pressurized contents of container 105 to spray through valve 109 and spray tip 107, and deliver the contents of container 105 as needed. There are many ways to design spray trigger 123 to cause spray tip 107 to open and release the contents of container 105 depending on the type of spray tip used. Two embodiments have been described herein, but many others would be apparent to one skilled in the art.

Figure 11:
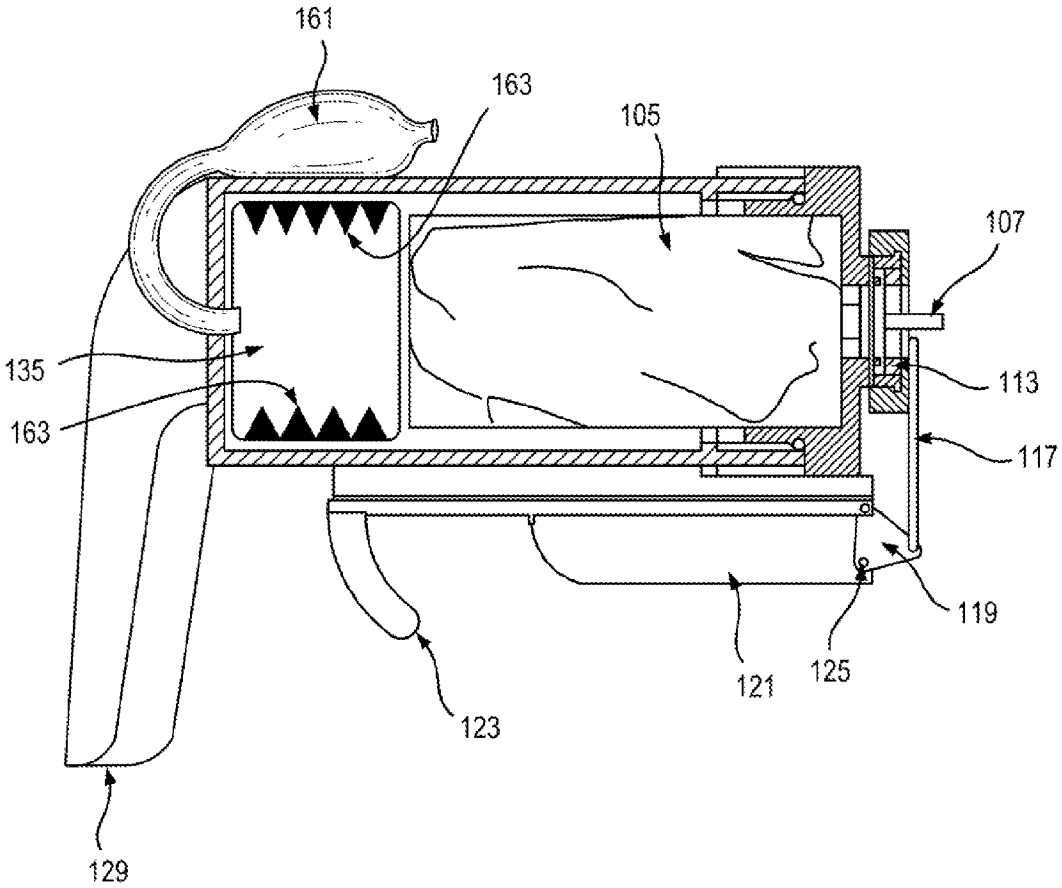
FIG. 11 is a side exterior view of a third embodiment of the dispenser system of the present invention using an air bladder.

FIG. 11 shows a pump 161 and air bladder 159 in combination to apply pressure to the piston and compress the container in place of the spring and plunger. By pumping up air bladder 159 with pump 161, air bladder 159 expands at expansion areas 163 to apply pressure directly to container 105 with the other components of the dispenser being as described above with respect to FIGS. 1-10. It is also possible to use a compressed air cartridge power source as an alternative to pump and air bladder 159 as a source of pressure against the piston.

Figure 12:
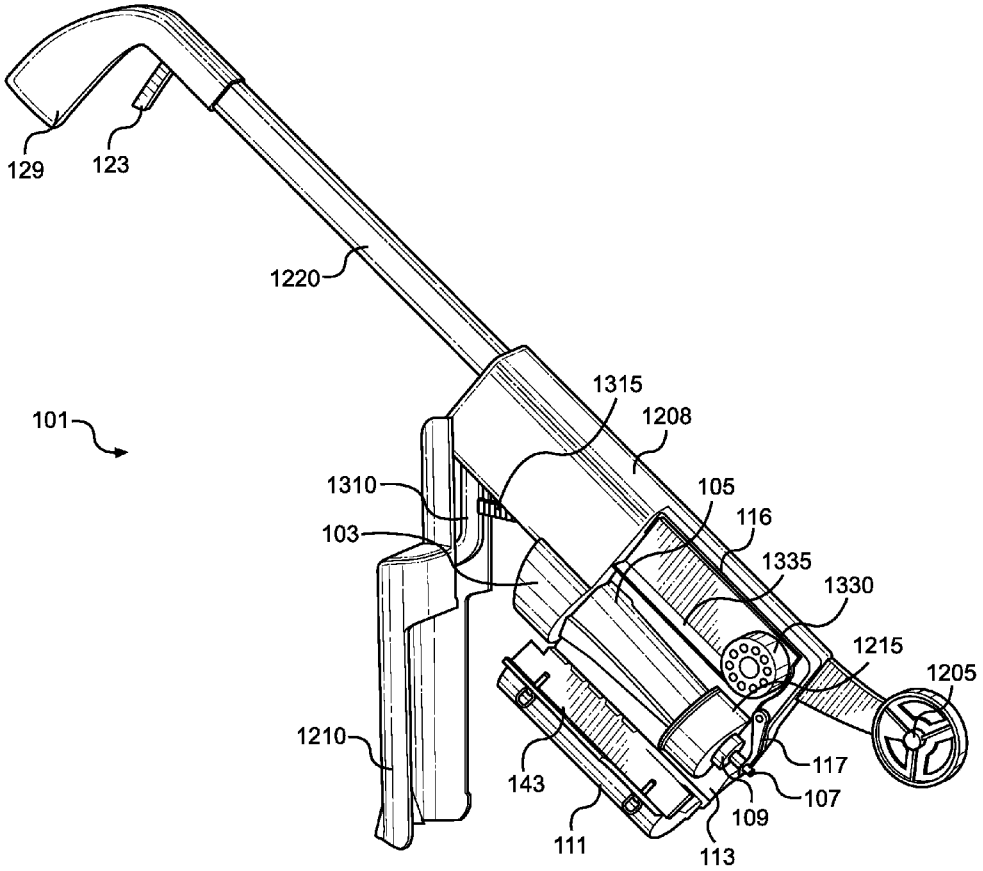
FIG. 12 is a perspective view of a fourth embodiment of the invention.

A fourth embodiment will now be described with respect to FIGS. 12-16. FIG. 12 shows a perspective view of a fourth embodiment of the invention. In the embodiment of FIG. 12, dispenser 101 includes an elongated mounting rod 1205, on which handle 129 and trigger 123 are positioned at one end, and housing 103 is positioned at the other end. Mounting rod 1205 extends the length of dispenser system 101 and permits a user to grasp handle 129 and operate trigger 123 at a distance from spray tip 107 so that spray tip may be near a spray target while the operator of system 101 is at a comfortable distance holding handle 129. For example, this configuration works well when system 101 is being used to spray a line down a length of road or on a grassy area to indicate the location of a gas line, water line, electrical line or other utility line. While mounting rod 1205 is useful in these types of applications, it is also possible to mount handle 129 and trigger 123 directly to housing 103 or an added upper portion 1208 of housing 103 within which other components of system 101 may be housed.

Figure 16:
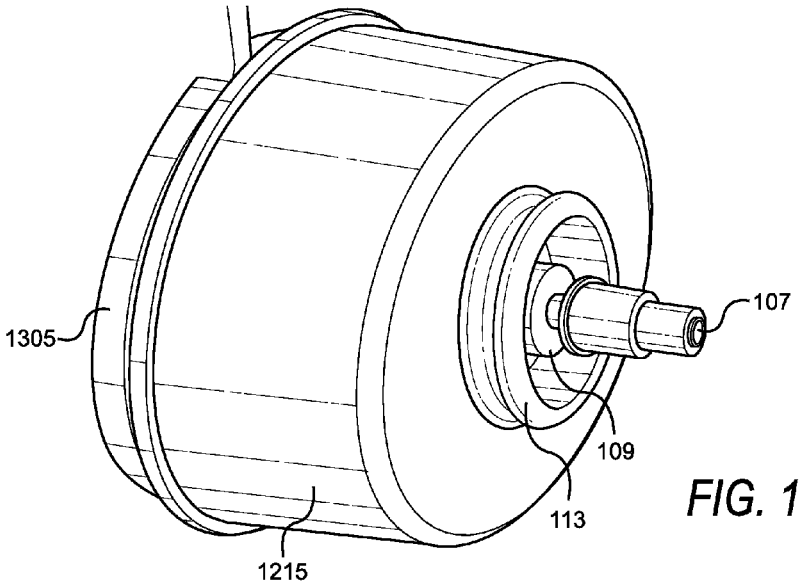
FIG. 16 is a perspective view of a fourth embodiment showing a cap, valve and spray tip.

According to the design of the fourth embodiment, flexible container 105, spray tip 107, valve 109 and valve seat 113 are all configured similarly to the other embodiments described above. A cylindrical shaped end cap 1215 shown in detail in FIG. 16 is positioned over the end of flexible container 105 to ease the seating of valve 109 in valve seat 113. It should be understood that end cap 1215 is an optional component and is not necessary for effective operation of the invention. If end cap 1215 is used, spray tip 107 and valve 109 are inserted through an opening in end cap 1215 and spray tip 107 and valve 109 further pass through to the outside of housing 103. End cap 1215 may be made of plastic, aluminum or other molded, lightweight, inexpensive material. During the process of sliding within housing 103 and crushing bag 105, as piston 1305 reaches the top of bag 105, it engages snugly against the open end of end cap 1215 to ensure that the contents of the bag are fully exited from bag 105.

Hinged panel 111 attached to housing 103 rotates between an open position in which flexible container 105 may be inserted into housing 103, and a closed position in which panel 111 forms a portion of housing 103 to securely maintain flexible container 105 within housing 103.

A guide wheel 1220 is shown attached to upper portion 1208 of housing 103. Guide wheel 1205 may be used to maintain the spray tip at a particular distance from the spray target as it is rolled along the ground or a wall. Guide wheel 1220 is an optional feature of dispenser 101.

Figure 13:
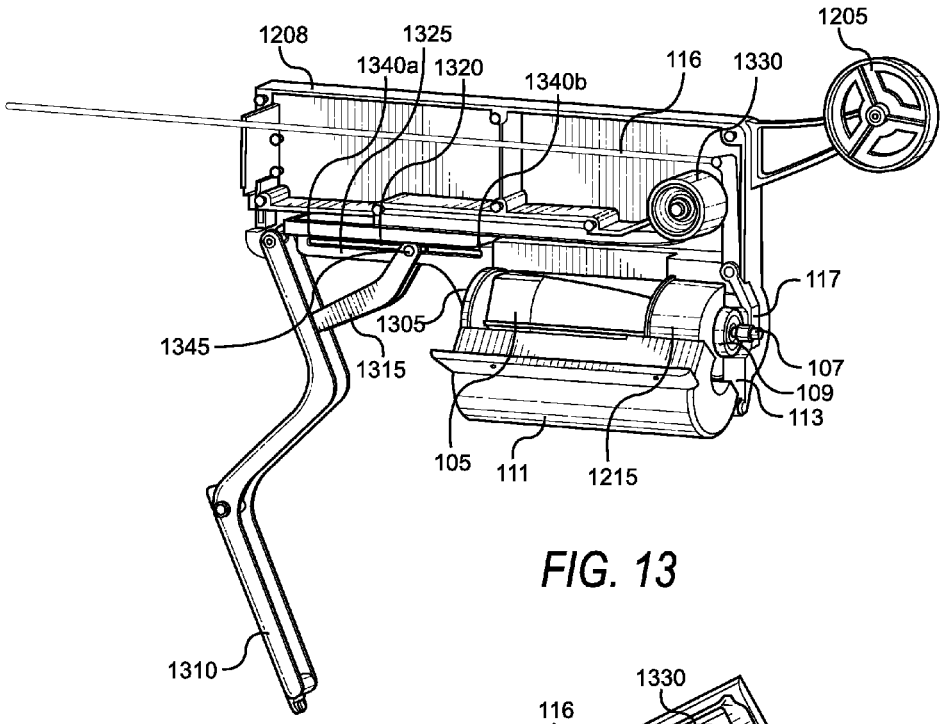
FIG. 13 is a cut-away side perspective view of the fourth embodiment of the invention.
Figure 14:
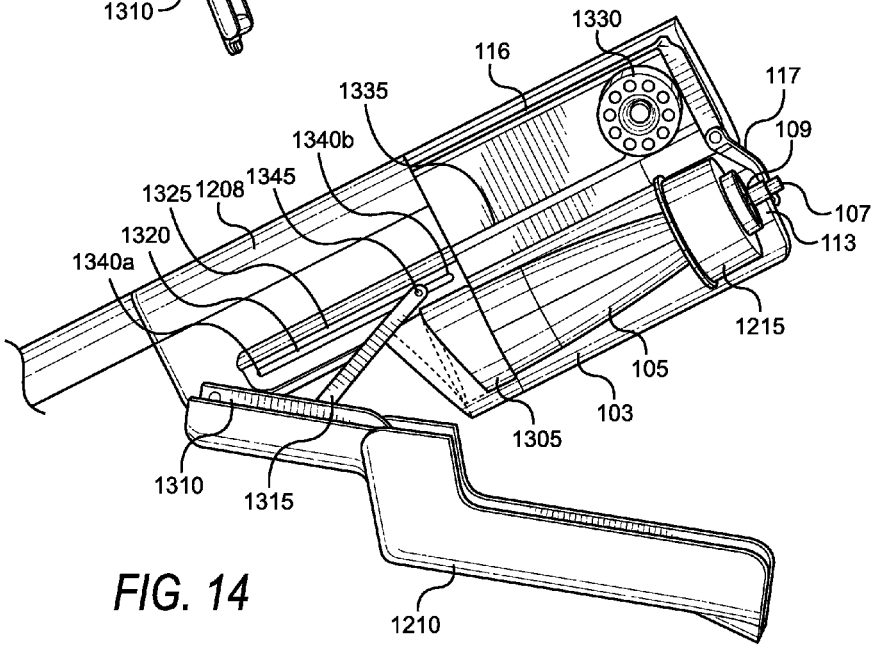
FIG. 14 is a cut-away side perspective view of a fourth embodiment showing a piston and associated components.
Figure 15:
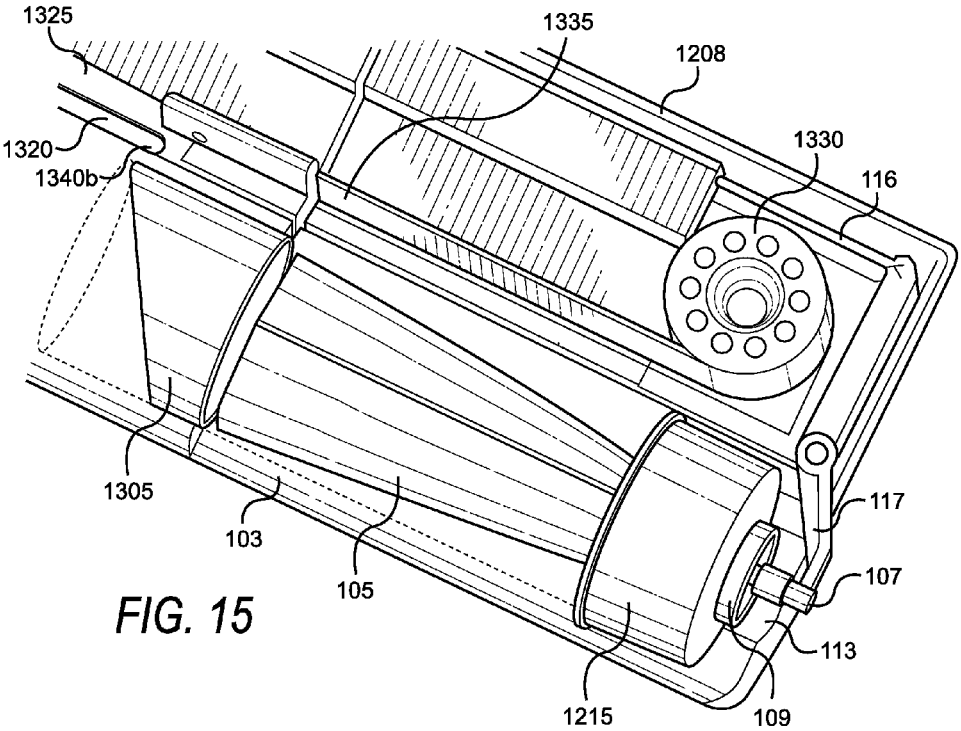
FIG. 15 is a side exterior view of a fourth embodiment showing a crushable container with a valve and spray tip.

A movable piston 1305 is shown in the cutaway view of dispenser 101 in FIG. 13 where the interior of housing 103 can be seen. Piston 1305 is biased against flexible container 105 and operates in a manner similar to piston 137 as described with respect to the embodiment of FIG. 1. Instead of using a trigger 127 to apply pressure to piston 137 against flexible container 105 as in the above described embodiments, in the embodiment of FIGS. 12-16, a coil spring 1330 is used. Coil spring 1330 is positioned inside housing 103 with an uncoiled end portion 1335 attached to piston 1305. Coil springs of the type such as coil spring 1330 as shown are well known and are biased to draw uncoiled end portion 1335 back towards coil 1330. In so doing, coil spring 1330 applies continuous pressure to piston 1305 to maintain piston 1305 in contact with the bottom of bag 105 pulling piston 1305 against bag 105 as bag 105 is crushed. The dimensions and tension of coil spring 1330 are design choices for the designer and depend on the size of bag 105, housing 103 and the positioning of coil spring 1330 in housing 103 relative to piston 1305.

A hinged lever 1310 (see FIG. 13) attached to a shell 1210 that matches the shape of the bottom of housing 103 is used to release piston 1305 so that a new bag may be inserted in dispenser 101 when the current bag has been emptied. When shell 1210 pivots between an open and a closed position, hinged lever 1310 mounted to the inside surface of shell 1210 moves an arm 1315, a first end of which is attached to hinged lever 1310 and a second end of which fits in a slot 1320 in a rib 1325 extending from the backside of piston 1305. When hinged lever 1310 is pivoted open or closed, a pin 1345 at the second end of arm 1315 moves through slot 1320 (see FIG. 14) between the two ends 1340*a* and 1340*b* of slot 1320. While a new container is inserted into housing 103, lever 1310 is open and arm 1315 is at end 1340*a*. When lever 1310 is closed, arm 1315 slides to end 1340*b* in slot 1320 and coil spring 1330 engages piston 1305 causing it to be pulled against flexible container 105. Pressure from coil spring 1330 is applied to the bottom of container 105, which in turn maintains pressure on the contents of container 105.

Figure 17:
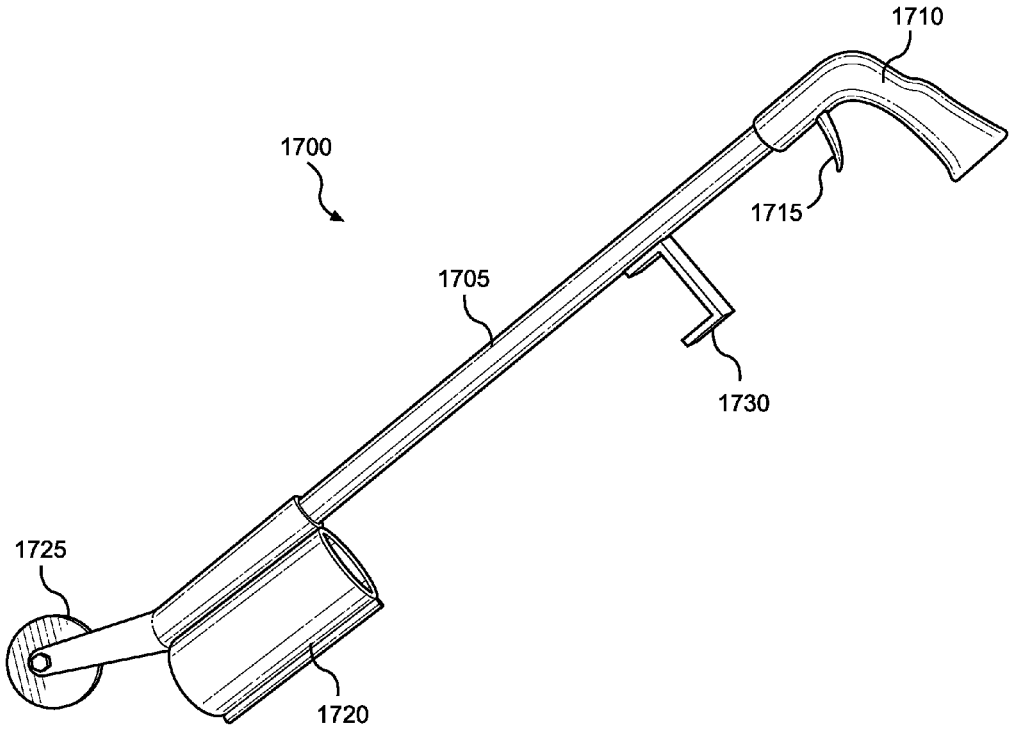
FIG. 17 shows a prior art marking stick for spraying sprayable material.

FIG. 17 shows a prior art marking stick for spraying sprayable material. Marking stick 1700 includes an elongated mounting rod 1705, on which handle 1710 and trigger 1715 are positioned at one end, and housing 1720 is positioned at the other end. Mounting rod 1705 extends the length of dispenser system 1700 and permits a user to grasp handle 1710 and operate trigger 1715 at a distance so that the spray tip of a spray can loaded into housing 1720 may be near a spray target while the operator of system 1700 is at a comfortable distance holding handle 1710. For example, this configuration is desirable when system 1700 is being used to spray a line down a length of road or on a grassy area to indicate the location of a gas line, water line, electrical line or other utility line. A guide wheel 1725 mounted at the end of rod 1705 or affixed to the end of housing 1720 permits a user to roll the end of marking stick 1700. Guide wheel 1725 may be used to maintain the spray tip at a particular distance from the spray target as it is rolled along the ground or a wall.

Figure 18:
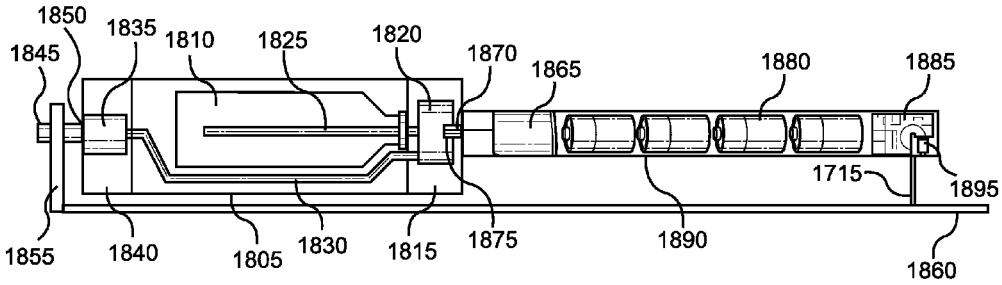
FIG. 18 is a fifth embodiment of the present invention with an electrically powered motor.

FIG. 18 shows a fifth embodiment of the present invention in which a cartridge 1805 loaded with a container 1810 coupled to an electrically powered motor assembly 1815. Cartridge 1805 is cylindrical in shape and approximates the size of a typical aerosol spray can. Cartridge 1805 may be manufactured of plastic, metal or any other suitable material. Cartridge 1805 is used to house container or bag 1810 which may be similar in composition to the crushable bags described with respect to the other embodiments. In this embodiment, container 1810 may also be formed of rigid or semi-rigid plastic, aluminum or another suitable material with a shape that fits within cartridge 1805. Cartridge 1805 may be configured such that upon container 1810 being emptied, a new container may be loaded into cartridge 1805 as a refill or replacement, or cartridge 1805 may be configured to hold a single container and disposed of upon the container being emptied.

Cartridge 1805 has a first end cap 1815 that includes a pump 1820 for pumping the sprayable material from container 1810 through a pump intake tube 1825 that is attached to pump 1820. The other end of intake tube 1825 is disposed in the bottom of container 1810 such that it draws up sprayable material from the inside of container 1810. Pump 1820 is also attached to an output tube 1830 through which the sprayable material exits pump 1820 and is delivered to a pressure reservoir 1835 housed within cartridge 1805, and preferably in a second end cap 1840 at the opposing end of cartridge 1805 from first end cap 1815. Pressure reservoir 1835 is further connected to spray tip 1845. Spray tip 1845 includes a valve 1850 and extends through an opening in end cap 1840. When cartridge 1805 is loaded into housing 1720 on marking stick 1700, spray tip 1845 pass through to the outside of housing 1720 for dispensing the sprayable material. End caps 1815 and 1845 may be made of plastic, aluminum or other molded, lightweight, low-cost material. An actuator arm 1855 mounted to rod 1705 responds to movement of an extended actuator rod 1860 running inside of marking stick rod 1705, which in turn is activated by trigger 1715 at the handle end of marking stick 1700.

Pump 1820 is powered by a drive motor 1865 coupled to pump 1820 by a driver 1870 that fits within a pump interface 1875 in end cap 1815. Motor 1865 is powered by one or more batteries 1880 or another portable power source. A motor controller 1885, along with motor 1865, pump interface 1870 and batteries 1880 are housed within motor assembly 1890 which may be an elongated structure aligned with cartridge 1805 and which may be removably affixed to rod 1705. An optical sensor 1895 is electrically connected to controller 1885 and mounted to detect movement of trigger 1705 to power motor 1865 "on" and "off" depending on the position of trigger 1715. It should be understood that other types of sensors could be substituted for the optical sensor including a mechanical switch attached to trigger 1715.

Figure 19:
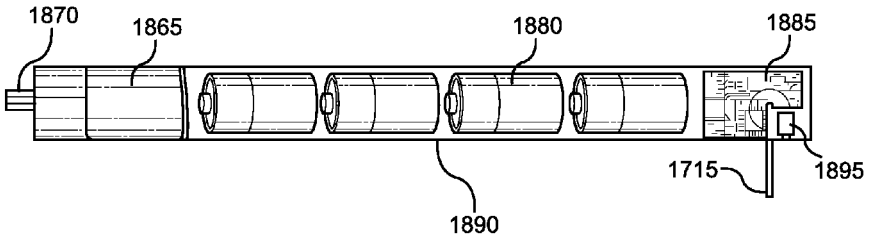
FIG. 19 is a detailed view of the motor assembly of the fifth embodiment.
Figure 20:
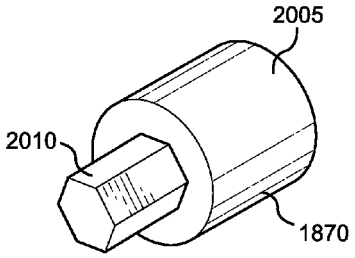
FIG. 20 is a detailed view of a hex driver for coupling the motor assembly to the cartridge.

FIG. 19 is a detailed view of motor assembly 1885 and FIG. 20 is a detailed view of driver 1870 for coupling motor assembly 1885 to cartridge 1805. Driver 1870 may be a hex shaped driver 1870 as shown in FIG. 20 with a cylindrically shaped base 2005 coupled to motor 1865 and including a hex shaped protrusion 2010 to engage pump interface 1875 in first end cap 1820 which is also hex shaped to match and mate to hex shaped driver 1870.

Figure 21:
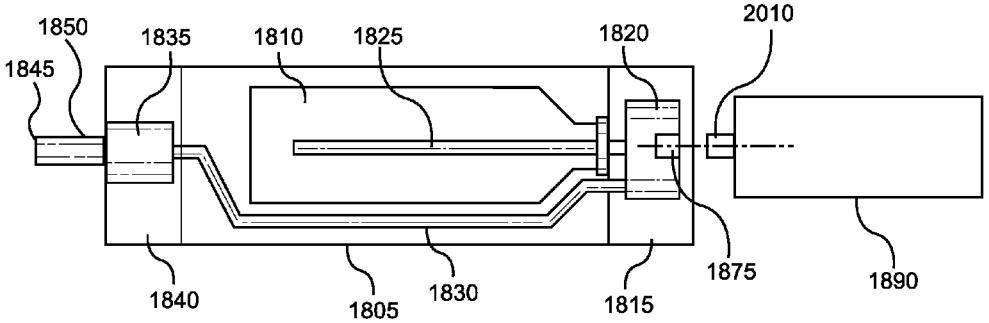
FIG. 21 is a cut-away view of a cartridge for holding a crushable container.

FIG. 21 is a detailed cut-away view of cartridge 1805 showing driver 1870 with hex shaped protrusion 2010 attached to motor assembly 1890, and aligned with and detached from pump interface 1875 in first end cap 1815.

Figure 22:
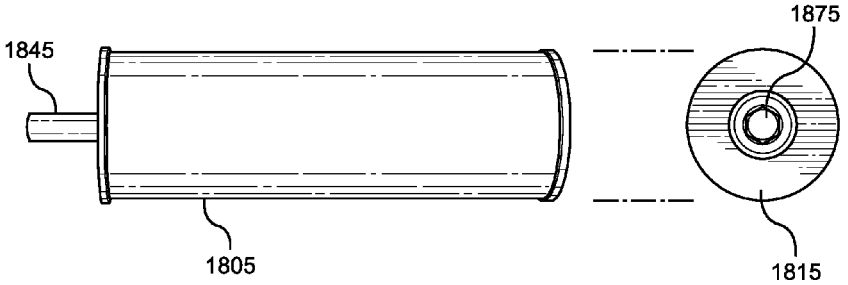
FIG. 22 is a side view of a cartridge with an aligned end view of end cap for accepting a hex drive.

FIG. 22 is a side view of cartridge 1805 with an aligned end view of first end cap 1815 including pump interface 1875 incorporated in end cap 1815. Pump interface 1875 is hex shaped to removably couple to hex shaped protrusion 2010.

Figure 23:
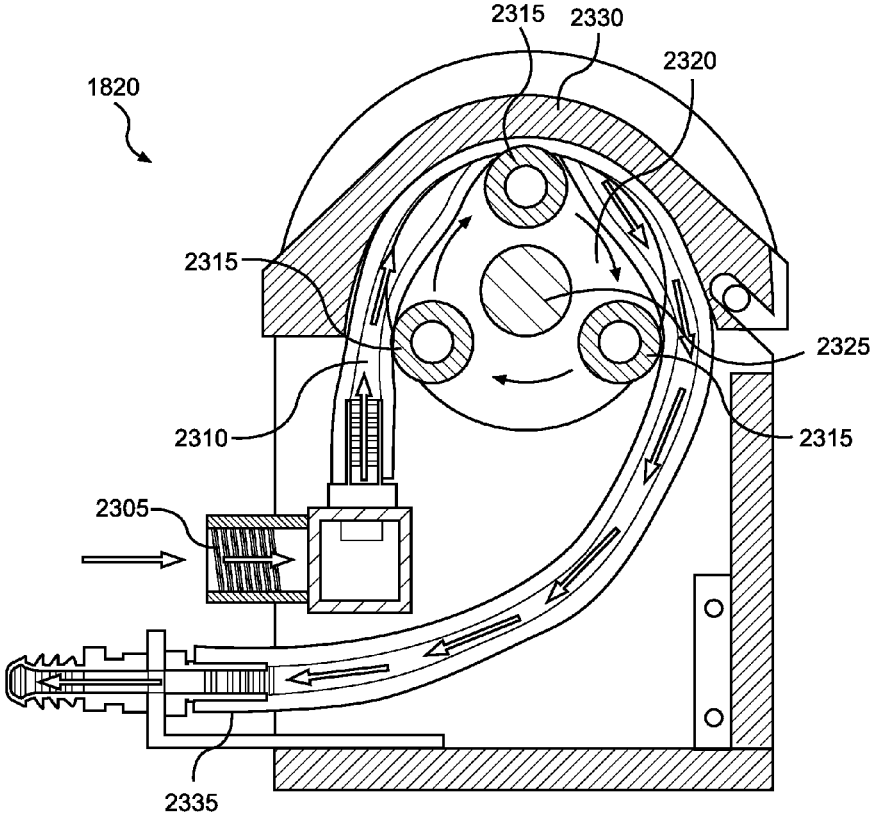
FIG. 23 is a cut-away view of a pump for pumping material from a container to a spray tip.

FIG. 23 is a cut-away detailed view of pump 1820 for pumping material from container 1810 to spray tip 1845. Pump 1820 may be a peristaltic pump of the type that is well known in the art. Pump intake tube 1825 is connected to an inlet manifold 2305. A flexible pump tube 2310 runs from inlet manifold 2305 through a set of rotating rollers 2315 rotated by motor 1865 which is mechanically connected to roller assembly 2320 at centerpoint 2325 when driver 1870 is removably attached to pump interface 1870. As roller assembly 2320 is driven in a rotational motion around centerpoint 2325 by motor 1865, rollers 2315 compress pump tube 2310 against rigid barrier 2330. The faster motor 1865 drives roller assembly 2320, the more liquid is pushed through pump tube 2310 where it moves in a pulsed but continuous flow before exiting through outlet 2335 into output tube 1830.

Figure 24:
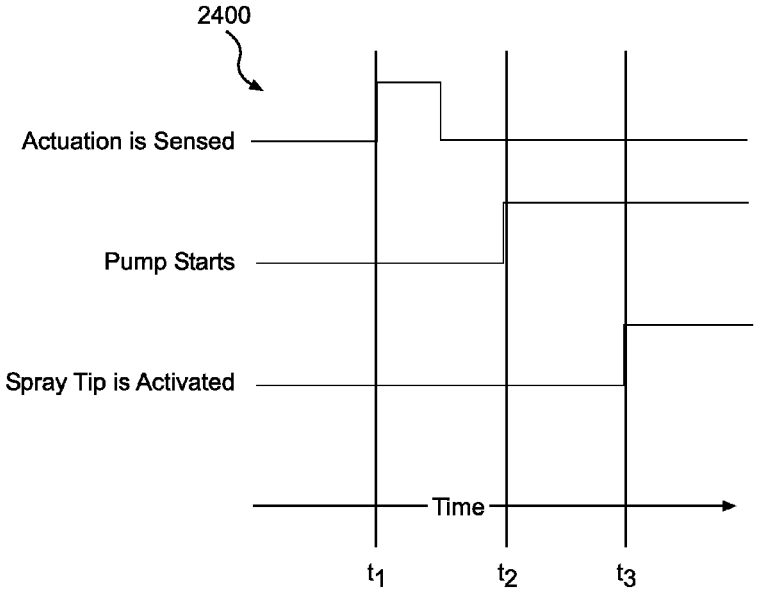
FIG. 24 shows a timing chart.

FIG. 24 shows a timing chart 2400 with the actions of sensor 1895, pump 1820 and spray tip 1845. In operation, sensor 1895 detects the movement of trigger 1715 on marking stick 1700. When the trigger movement is detected, a signal is transmitted by controller 1885 at $t_1$ to activate motor 1865 starting pump 1820 at $t_2$, and opening valve 1850 to release material from spray tip 1845 at $t_3$.

Figure 25A:
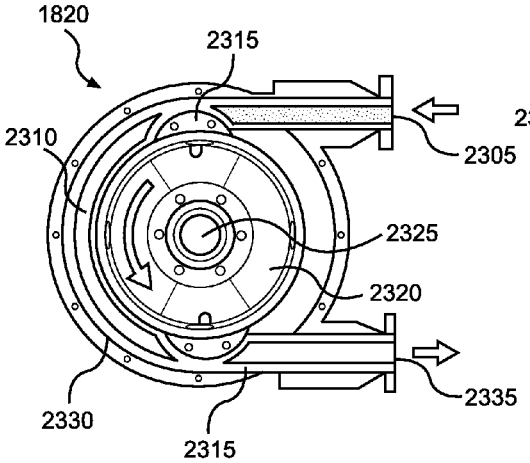
FIGS. 25A-C are views of a pump assembly as material is being pumped through a pump tube.
Figure 25B:
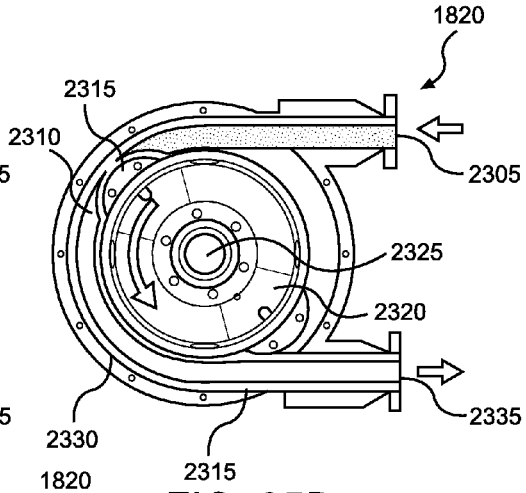
Figure 25C:
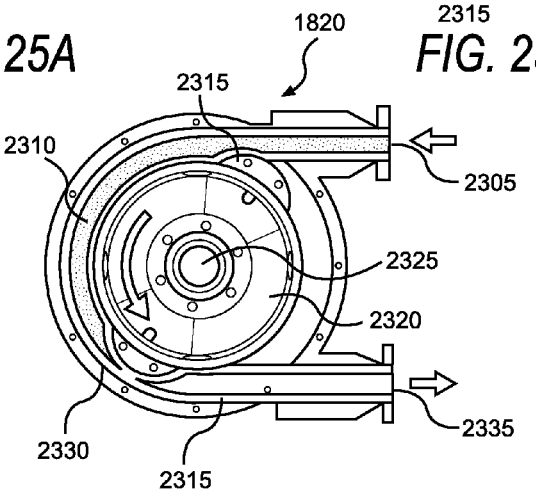

FIGS. 25A-C show three views of pump 1820 as the sprayable material is pumped through tube 2310. As can be seen in FIG. 25A, material starts to flow into pump tube 2310. As rotor assembly 2320 turns, rollers 2315 squeeze tube 2310 against rigid barrier 2330. This action causes material to be continuously pumped through pump tube 2310 as shown in FIGS. 25B and 25C. Spray tip 1845 is activated after pump 1820 has pumped material through the system and pressurized the material to be dispensed at spray tip 1845.

Figure 26:
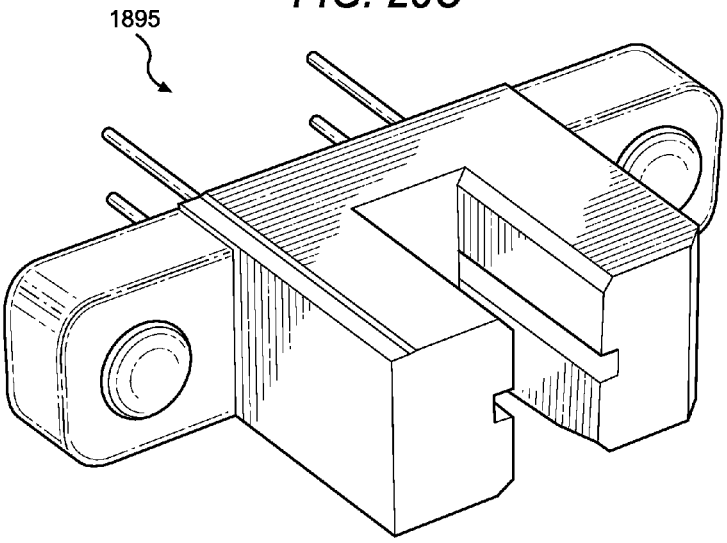
FIG. 26 is a view of an optical sensor.

FIG. 26 is a view of an optical sensor 1895, an example of which is manufactured by Vishay Semiconductor. Optical sensor 1895 is electrically connected to controller 1885 and mounted to detect movement of trigger 1705 and alternatively power motor 1865 "on" and "off" depending on the position of trigger 1705. Detecting the movement of trigger 1705 provides time to start operation of pump 1820 so that pressure can build in the system before mechanical actuation of spray head 1845. The build-up of pressure allows the start of the spray stream of material to be at full power as opposed to dribbling out of spray head 1845.

In operation, cartridge 1805 is loaded into housing 1720 on marking stick 1700 with spray tip 1845 passing through to the outside of housing 1720 to permit the dispensing of sprayable material from crushable container 1810. Once cartridge 1805 is positioned in marking stick 1705, an actuator arm 1855 mounted to rod 1705 responds to movement of an extended actuator rod 1860 running inside of marking stick rod 1705, which in turn is activated by trigger 1715 at the handle end of marking stick 1700. Pulling trigger 1715 causes valve 1850 to open dispensing material through spray tip 1845. At the same time that trigger 1715 is pulled, optical sensor 1895 transmits a signal to controller 1885. Controller, in turn, powers motor 1865 which electrically rotates driver 1870 in pump interface 1875. As pump interface rotates, pump 1820 creates pressure in intake tube 1825 that draws sprayable material up through intake tube 1825, into pump 1820 and out through exit tube 1830 where it collects under pressure in reservoir 1835 and is available to be dispensed under pressure when valve 1850 opens.

The present invention benefits from the configuration of cartridge 1805 housing container 1810, pump 1820, reservoir 1835, spray head 1845 and valve 1850 along with tubes 1825, 1830 and pump interface 1875 wherein these components are separated from motor assembly 1890 that includes motor 1865, driver 1870, controller 1885 and power source 1880. In this way, motor assembly 1865 can be easily attached to cartridge 1805 and removed when the sprayable material is emptied from container 1810. Driver 1870 is preferably spring-loaded on motor assembly 1890 so that it may be detached from cartridge 1805 at pump interface 1875, and quickly and easily reattached to a new cartridge 1805 or a used cartridge with a new container 1810 installed.

The combination of pump 1820 with reservoir 1835 also functions to maintain pressure in the system even when power is not being supplied to pump 1820. The combination permits spray head 1845 to be turned "on" and "off" to exhibit absolute flow without any delay in pressure build up in the system. This maintains a smooth, uninterrupted spray pressure to provide adequate atomization and also eliminates drool-like tendencies at the spray tip when power is not being supplied to pump 1820.

Motor 1865 may be any DC driver armature or stepper motor. It is desirable to provide reverse functionality so that paint may be siphoned back into container 1810 through tube 1830, pump 1820 and tube 1825 or to relieve access pressure. Pressure may be sensed by the amount of current that motor 1865 is drawing or electromotive force ("EMF") on the motor using a sensor on motor 1865.

While the invention has been described with respect to the figures, it will be appreciated that many modifications and changes may be made by those skilled in the art without departing from the spirit of the invention. Any variation and derivation from the above description and drawings are included in the scope of the present invention as defined by the claims. For example, cartridge 1805 may be "refillable" once crushable container 1810 is emptied. In that case, cartridge 1805 may be formed of a hinged casing that could be opened once a crushable container is emptied so that a new crushable container could be loaded into cartridge 1805. Further, the embodiment described with respect to FIGS. 17-25 shows an optical sensor for detecting the position of the trigger. Other types of switches or sensors could be substituted for the optical sensor including a mechanical switch attached to the trigger.

What is claimed is:

1. A system for dispensing sprayable material comprising:
a dispenser;
a cartridge comprising:
a first end cap;
a second end cap; and
a body formed with an interior portion between the first end cap and the second end cap;
a container within which a sprayable material is contained, the container positioned within the interior portion of the body;
an intake tube having a first end disposed within the container and a second end;
a pump with an inlet connected to the second end of the intake tube that draws the sprayable material from the container through the intake tube;
an exit tube having a first end connected to an outlet of the pump and through which the sprayable material entering the pump is output, and a second end;
a spray tip having a valve in fluid connection with the second end of the exit tube; and
a trigger mounted to the dispenser that moves between a first position and a second position, wherein
in the first position, the pump is activated and the valve is opened releasing the sprayable material; and
in the second position, the pump is de-activated and the valve is closed.

2. The system of claim 1 further comprising a reservoir for the sprayable material wherein the reservoir fills with the sprayable material and maintains pressure at the valve whether the pump is activated or de-activated.

3. The system of claim 1 wherein the container is of a type from a group comprising: (a) a crushable material; (b) a semi-rigid material; or (c) a rigid material; wherein the material is substantially completely expelled from the container under pressure from the pump.

4. The system of claim 1 further comprising a guide wheel that is affixed to the dispenser and which rotates as the system is moved linearly maintaining the spray tip at a fixed distance from a spray target.

5. The system of claim 1 further comprising a sensor that detects the position of the trigger and transmits a signal indicating the position of the trigger.

6. The system of claim 1 further comprising a controller that is programmed to activate the pump when the trigger is in the first position and to de-activate the pump when the trigger is in the second position.

7. The system of claim 1 further comprising:
a pump interface in the first end cap; and
a driver driven by the motor and removably engaged with the pump interface, wherein activating the motor rotates the driver, which in turn rotates the pump interface powering the pump.

8. The system of claim 1 further comprising a handle affixed to the dispenser.

9. The system of claim 1 wherein the pump further comprises a roller assembly with at least one roller, a flexible tube and a rigid barrier, wherein the roller assembly is driven rotated around a center point by the motor with the rollers squeezing the flexible tube against the rigid barrier to push the sprayable material through the flexible tube.

10. A system for dispensing sprayable material, comprising:
a dispenser having an elongated body with a handle at a first end of the dispenser;
a cartridge that is removably attached to the dispenser comprising:
a first end cap;
a second end cap;
a body with an interior portion between the first end cap and the second end cap; and
a moveable panel;
a container within which a sprayable material is contained, the container being removably inserted into the interior portion of the body;
an intake tube having a first end disposed within the container and a second end;
a pump with an inlet connected to the second end of the intake tube that draws the sprayable material from the container through the intake tube;
an exit tube having a first end connected to the pump and through which the sprayable material entering the pump is output, and a second end;
a spray tip having a valve in fluid connection with the second end of the exit tube; and
a trigger that moves between a first position and a second position, wherein
in the first position, the pump is activated and the valve is opened releasing the sprayable material; and
in the second position, the pump is de-activated and the valve is closed.

11. The system of claim 10 wherein the movable panel is a door that is affixed to the body.

12. The system of claim 10 further comprising a reservoir for the sprayable material wherein the reservoir fills with the sprayable material and maintains pressure at the valve whether the pump is activated or de-activated.

13. The system of claim 10 wherein the container is of a type from a group comprising: (a) a crushable material; (b) a semi-rigid material; or (c) a rigid material; wherein the material is substantially completely expelled from the container under pressure from the pump.

14. The system of claim 10 further comprising a guide wheel that is affixed to a second end of the dispenser and which rotates as the system is moved linearly maintaining the spray tip at a fixed distance from a spray target.

15. The system of claim 10 further comprising a sensor that detects the position of the trigger and transmits a signal indicating the position of the trigger.

16. The system of claim 10 further comprising a controller that is programmed to activate the pump when the trigger is in the first position and to de-activate the pump when the trigger is in the second position.

17. The system of claim 10 further comprising:
a pump interface in the first end cap; and
a driver driven by the motor and removably engaged with the pump interface, wherein activating the motor rotates the driver, which in turn rotates the pump interface powering the pump.

18. The system of claim 10 wherein the trigger is mounted to the handle.

19. The system of claim 10 wherein the pump further comprises a roller assembly with at least one roller, a flexible tube and a rigid barrier, wherein the roller assembly is driven rotated around a center point by the motor with the rollers squeezing the flexible tube against the rigid barrier to push the sprayable material through the flexible tube.

20. A method for dispensing sprayable material from a dispenser comprising:
inserting a cartridge in the dispenser, wherein the cartridge comprises a first end cap, a second end cap and a body formed with an interior portion between the first end cap and the second end cap;
positioning a container within the cartridge, the container holding the sprayable material;

drawing the sprayable material through an intake tube using a pump wherein a first end of the intake tube is disposed in the container and a second end of the intake tube is connected to an inlet of the pump;

outputting the sprayable material through an outlet of the pump and into an exit tube;

pressurizing the sprayable material against a valve connected to the exit tube; and opening the valve to release the sprayable material through a spray tip responsive to a trigger.

21. The method of claim 20 wherein the sprayable material fills a reservoir after being output from the outlet and before reaching the valve.

22. The method of claim 20 wherein the container is of a type from a group comprising: (a) a crushable material; (b) a semi-rigid material; or (c) a rigid material; wherein the material is substantially completely expelled from the container under pressure from the pump.

23. The method of claim 20 wherein the dispenser further comprising affixing a guide wheel to the dispenser and rotating the guide wheel as it is moved linearly maintaining the spray tip at a fixed distance from a spray target.

24. The method of claim 20 further comprising using a sensor to detect the position of the trigger and transmitting a signal indicating the position of the trigger.

25. The method of claim 20 further comprising a controller that is programmed to activate the pump when the trigger is in the first position and to de-activate the pump when the trigger is in the second position.

26. The method of claim 20 further comprising:

positioning a pump interface in the first end cap; and driving a driver removably engaged with the pump interface using the motor, wherein activating the motor rotates the driver, which in turn rotates the pump interface powering the pump.

27. The method of claim 20 wherein the trigger is mounted to the dispenser.

28. The method of claim 20 wherein the pump further comprises a roller assembly with at least one roller, a flexible tube and a rigid barrier, wherein the roller assembly is driven rotated around a center point by the motor with the rollers squeezing the flexible tube against the rigid barrier to push the sprayable material through the flexible tube.

* * * * *